US006599079B1

(12) United States Patent
Hermanson et al.

(10) Patent No.: US 6,599,079 B1
(45) Date of Patent: Jul. 29, 2003

(54) APPARATUS FOR LOCKING A WHEELCHAIR LIFT IN THE STOWED POSITION

(75) Inventors: Jeffrey J. Hermanson, Culver, IN (US); James R. Pierrou, Winamac, IN (US); Russell G. Antrim, Winamac, IN (US); Alfred Budd, Winamac, IN (US); Ned W. McCormick, Winamac, IN (US)

(73) Assignee: The Braun Corporation, Winamac, IN (US)

( * ) Notice: Subject to any disclaimer, the term of this patent is extended or adjusted under 35 U.S.C. 154(b) by 80 days.

(21) Appl. No.: 09/702,397

(22) Filed: Oct. 31, 2000

Related U.S. Application Data

(60) Provisional application No. 60/175,746, filed on Jan. 12, 2000.

(51) Int. Cl.[7] ..... A61G 3/08

(52) U.S. Cl. ..... 414/546; 414/921

(58) Field of Search ..... 254/10 R, 10 C; 414/921, 546, 556, 557; 292/297, 298, DIG. 4, 240, 194, 219; 298/23 R, 23 M, 23 MD

(56) References Cited

U.S. PATENT DOCUMENTS

| | | | | | |
|---|---|---|---|---|---|
| 3,811,729 | A | * | 5/1974 | Vornberger | 298/23 M |
| 4,138,023 | A | | 2/1979 | Rohrs et al. | |
| 4,576,541 | A | * | 3/1986 | Dunn et al. | 414/545 |
| 4,808,056 | A | | 2/1989 | Oshima | 414/462 |
| 5,085,555 | A | | 2/1992 | Vartanian | 414/537 |
| 5,263,808 | A | * | 11/1993 | Kent | 414/545 |
| 5,445,488 | A | | 8/1995 | Saucier et al. | 414/546 |
| 5,542,811 | A | | 8/1996 | Vartanian | 414/541 |
| 5,641,262 | A | * | 6/1997 | Dunlop et al. | 414/557 |

FOREIGN PATENT DOCUMENTS

| | | | |
|---|---|---|---|
| DE | 31 23 546 | 6/1981 | B60P/1/44 |
| GB | 2 207 111 | 7/1987 | B60P/1/44 |
| JP | 57-186541 | 11/1982 | B60P/3/06 |

* cited by examiner

*Primary Examiner*—Steven A. Bratlie
(74) *Attorney, Agent, or Firm*—Michael, Best & Friedrich, LLC

(57) ABSTRACT

A wheelchair lift having a foldable platform including a first platform portion foldably coupled to a second platform portion, a lifting frame, at least one lifting arm with one end pivotally coupled to the lifting frame and the other end connected to the second platform portion and adapted to pivot the lifting arm between a substantially vertical stowed position and a substantially horizontal deployed position. A post extends from the lifting arm and a locking assembly is pivotably coupled to the lifting frame. The locking assembly includes a lever arm pivotably coupled to the lifting frame, a gas spring extending between the lever arm and the lifting frame which operates to resist pivoting of the lever arm, and a mechanical spring extending between the lever arm and the lifting frame which exerts a biasing force operating to pivot the lever arm to engage the post. Pivoting the lifting arm to the deployed position actuates unfolding the platform, while pivoting the lifting arm to the stowed position actuates folding the platform and engages the post with the lever arm.

25 Claims, 11 Drawing Sheets

APPARATUS FOR LOCKING A WHEELCHAIR LIFT IN THE STOWED POSITION

CROSS-REFERENCE TO RELATED APPLICATIONS

The present application claims priority under 35 U.S.C. § 120 from U.S. Provisional Application Ser. No. 60/175,746, filed Jan. 12, 2000.

TECHNICAL FIELD OF THE INVENTION

The present invention generally relates to passenger or wheelchair lifts and, more particularly, to an apparatus for locking a wheelchair lift in the stowed position.

BACKGROUND OF THE INVENTION

As is known in the art, various types of lifting devices are used to move passengers between a lowered level, such as a ground level, and an elevated level, such as the floor level of a vehicle. For example, U.S. Pat. No. 5,445,488 to Saucier et al., the specification and drawings of which are hereby incorporated by reference herein in their entirety, illustrates therein a typical dual parallel arm hydraulic lift, which is reproduced herein as FIG. 1.

The lift L includes a platform 12 that may be used to lift passengers, such as those in wheelchairs, from a ground level to a floor level F of the vehicle V by actuation of hydraulic cylinders 38. When the platform 12 reaches the floor level F, a bridge plate 34, which is pivotally coupled to the platform 12, operates to bridge any gap between the platform 12 and the floor F, thereby allowing smooth transfer of the wheelchair between the platform 12 and an interior of the vehicle V.

When not in use, the platform 12 is folded to a vertical position (the stowed position) such that the entire lift L is disposed within the vehicle V, allowing the doorway D of the vehicle V to be closed. A known problem with such an arrangement is that the hydraulic cylinders 38 will typically drift over time, possibly allowing the platform 12 to come to rest against the inside of the vehicle door. Not only can this produce an annoying rattling during movement of the vehicle, but it can also impede operation of the door.

A solution to this problem is proposed in the '488 patent by locking a protrusion on the bottom of the bridge plate 34 into a cavity 41 in the vehicle floor F. Interference between the bridge plate 34 (which is attached to the platform 12) and the cavity 41 prevents the stowed platform 12 from drifting outward. This solution is undesirable for a number of reasons, chief among them being the relatively large number of parts required to releasably latch the bridge plate 34.

There is therefore a need for an apparatus that prevents drift of a stowed lift platform, without requiring a large number of parts or a complex interconnection of those parts. The present invention is directed toward meeting this need.

SUMMARY OF THE INVENTION

The present invention relates to a wheelchair-lifting platform for transporting a passenger seated in a wheelchair back and forth between a passenger door of a vehicle and the ground, such that the platform can be automatically folded, retracted, secured and stored in the vehicle when not in use and that can be automatically released, unfolded and deployed when in use. One embodiment of the present invention is an automatically folding and unfolding platform having a spring-loaded and dampened latching hook that automatically latches the platform when it is retracted and automatically releases the platform at the start of its deployment cycle. The platform is folded and stored within the vehicle when not in use.

One object of the present invention is to provide an improved wheelchair-lifting platform. Related objects and advantages of the present invention will be apparent from the following description.

DETAILED DESCRIPTION OF THE PREFERRED EMBODIMENT

Figure 1:
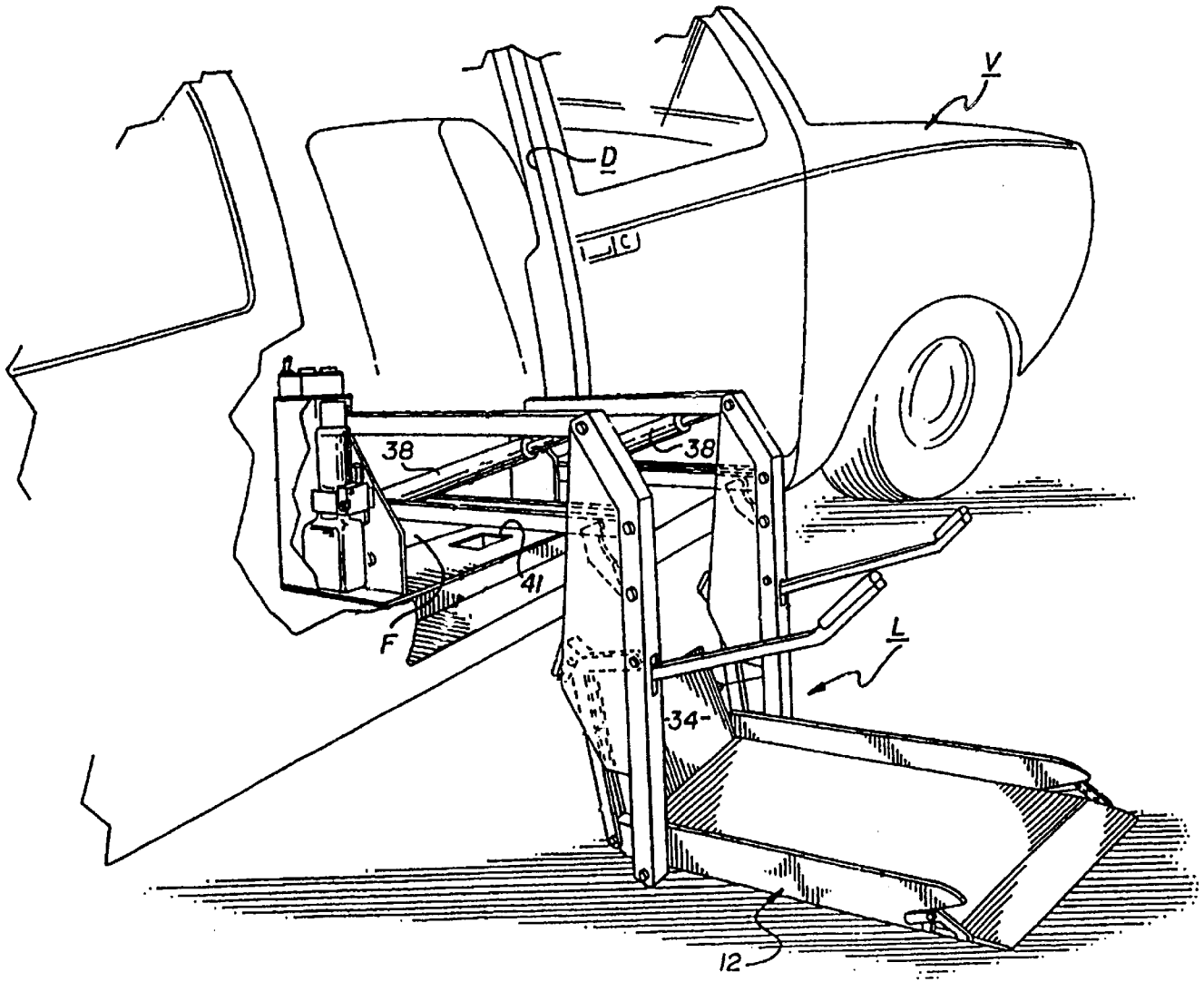
FIG. 1 (PRIOR ART)
FIG. 1 is a perspective view of a prior art wheelchair lift extending from a vehicle.
Figure 3:
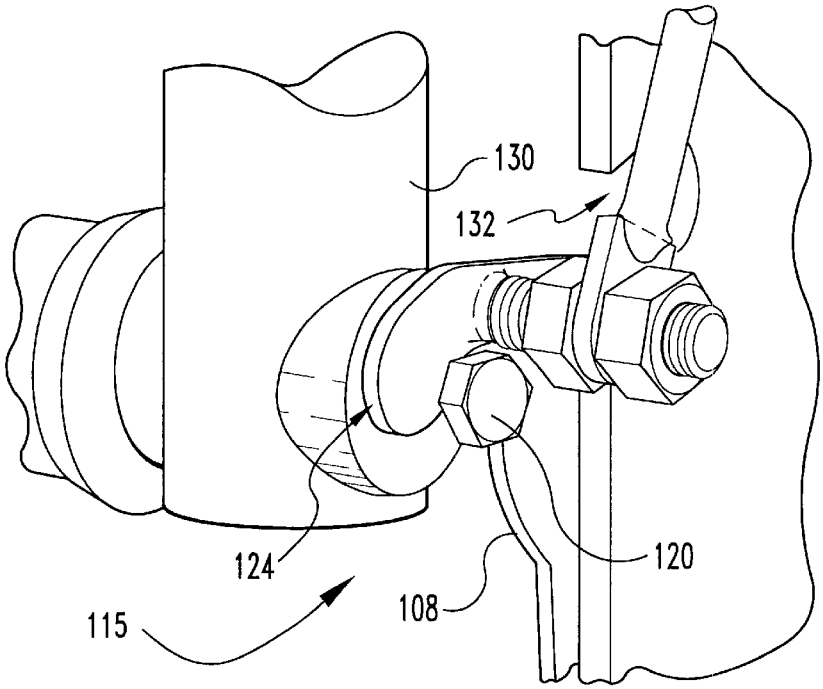
FIG. 3 is a first enlarged partial perspective view of the embodiment of FIG. 2.
Figure 2:
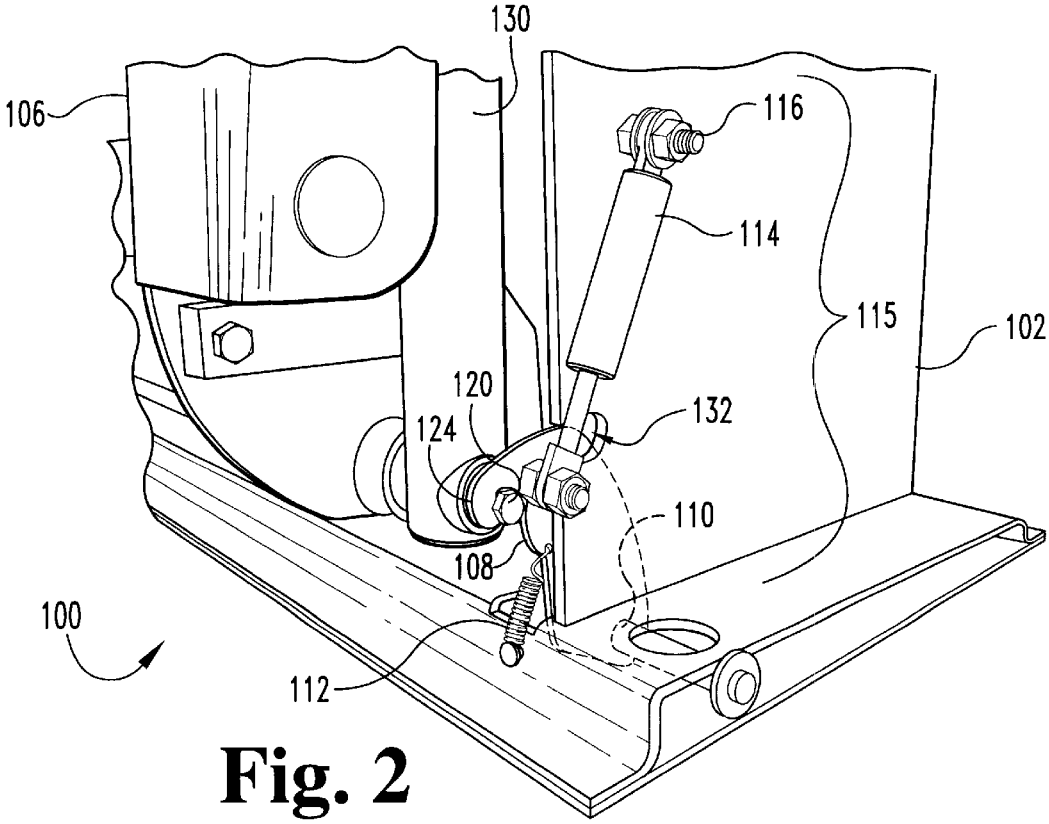
FIG. 2 is a partial perspective view of a first embodiment of the present invention, a wheelchair lift secured by a locking assembly.
Figure 4:
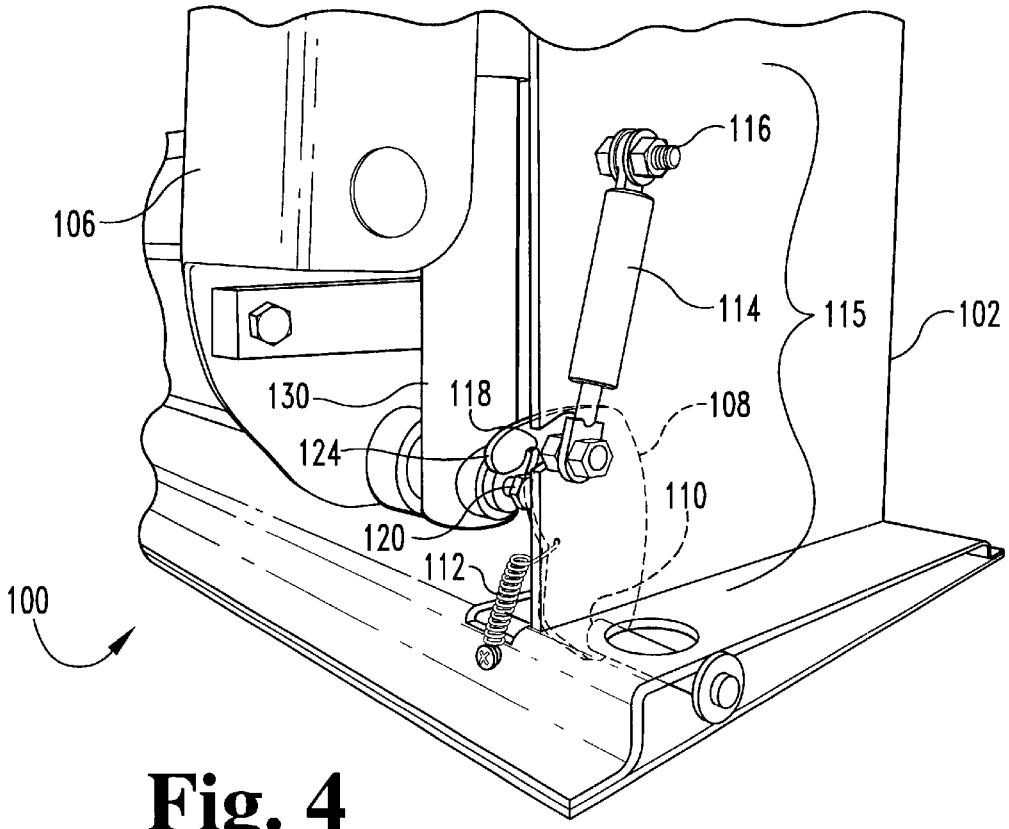
FIG. 4 is a second enlarged partial perspective view of FIG. 2.
Figure 5:
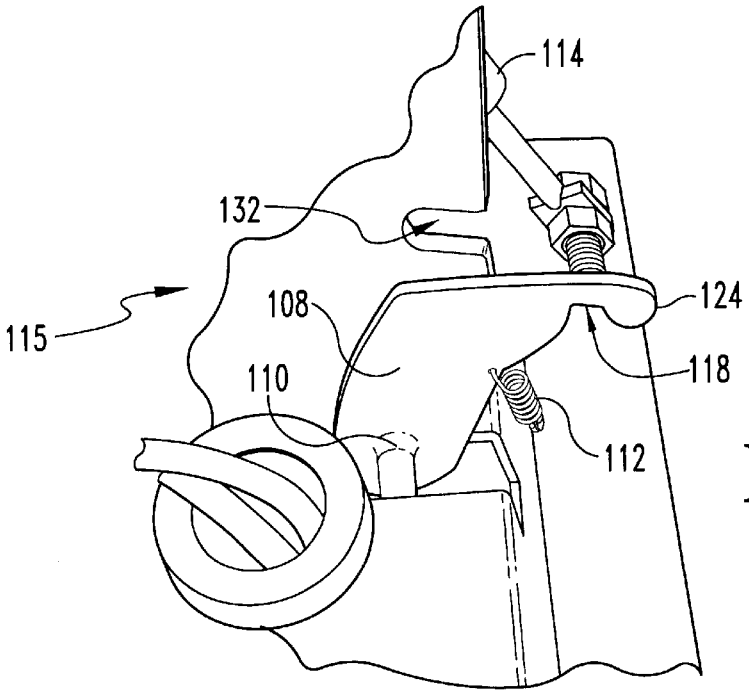
FIG. 5 is a third enlarged partial perspective view of the locking assembly of FIG. 2.
Figure 6A:
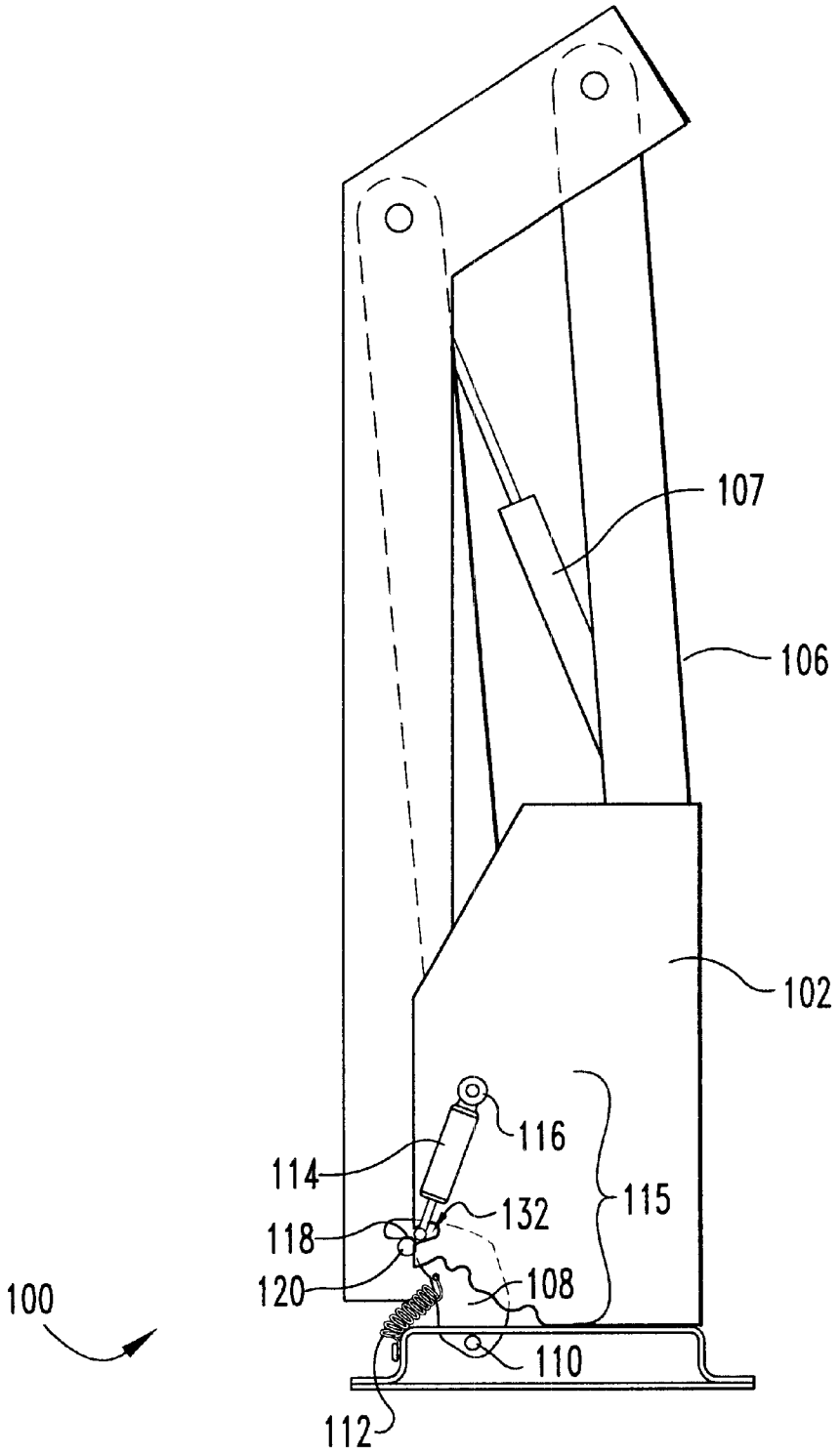
FIG. 6A is a schematic view of the platform assembly of the present invention in a folded and locked position.
Figure 6B:
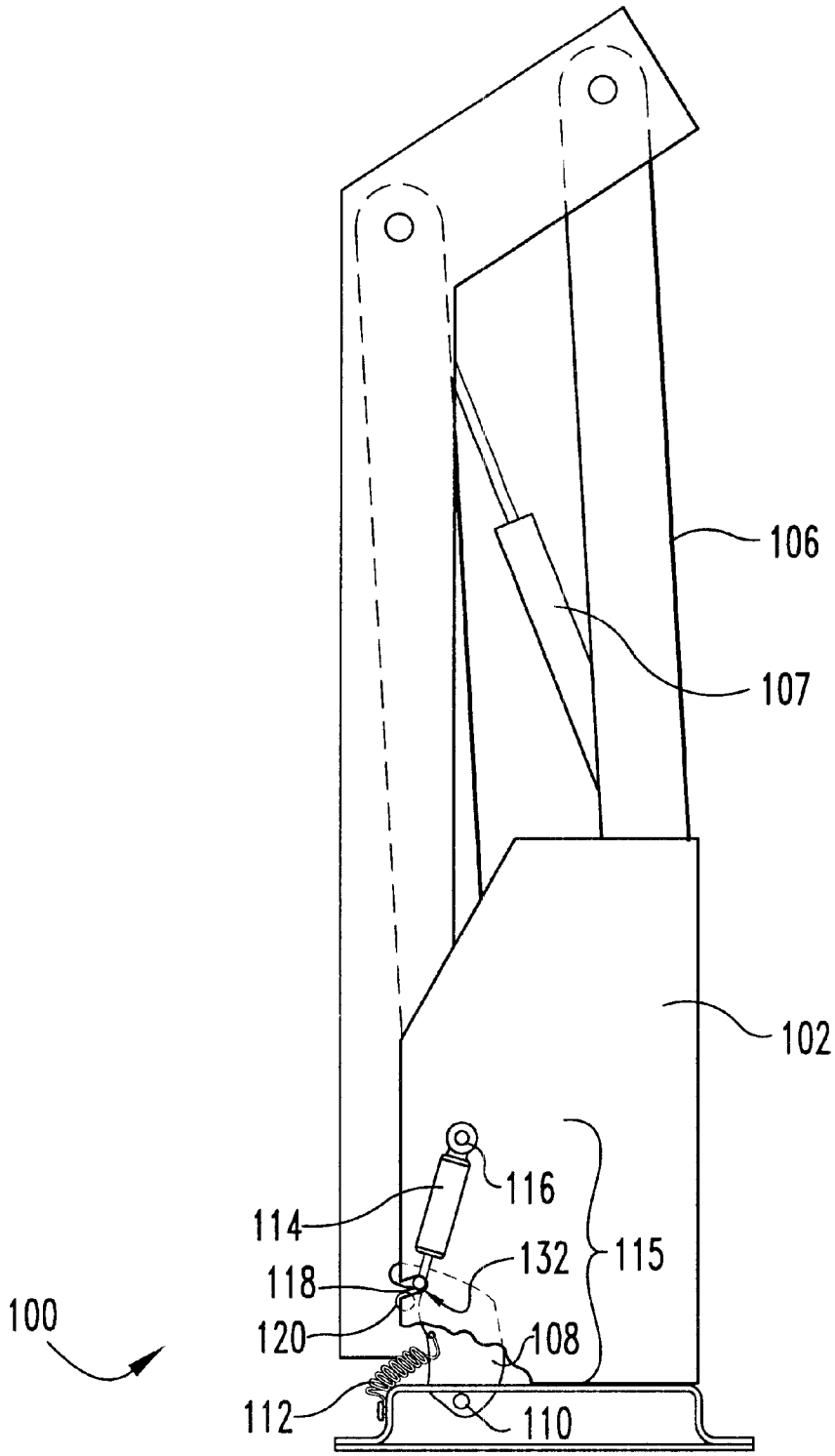
FIG. 6B is a schematic view of the platform assembly of the present invention in a folded and unlocked position.
Figure 6C:
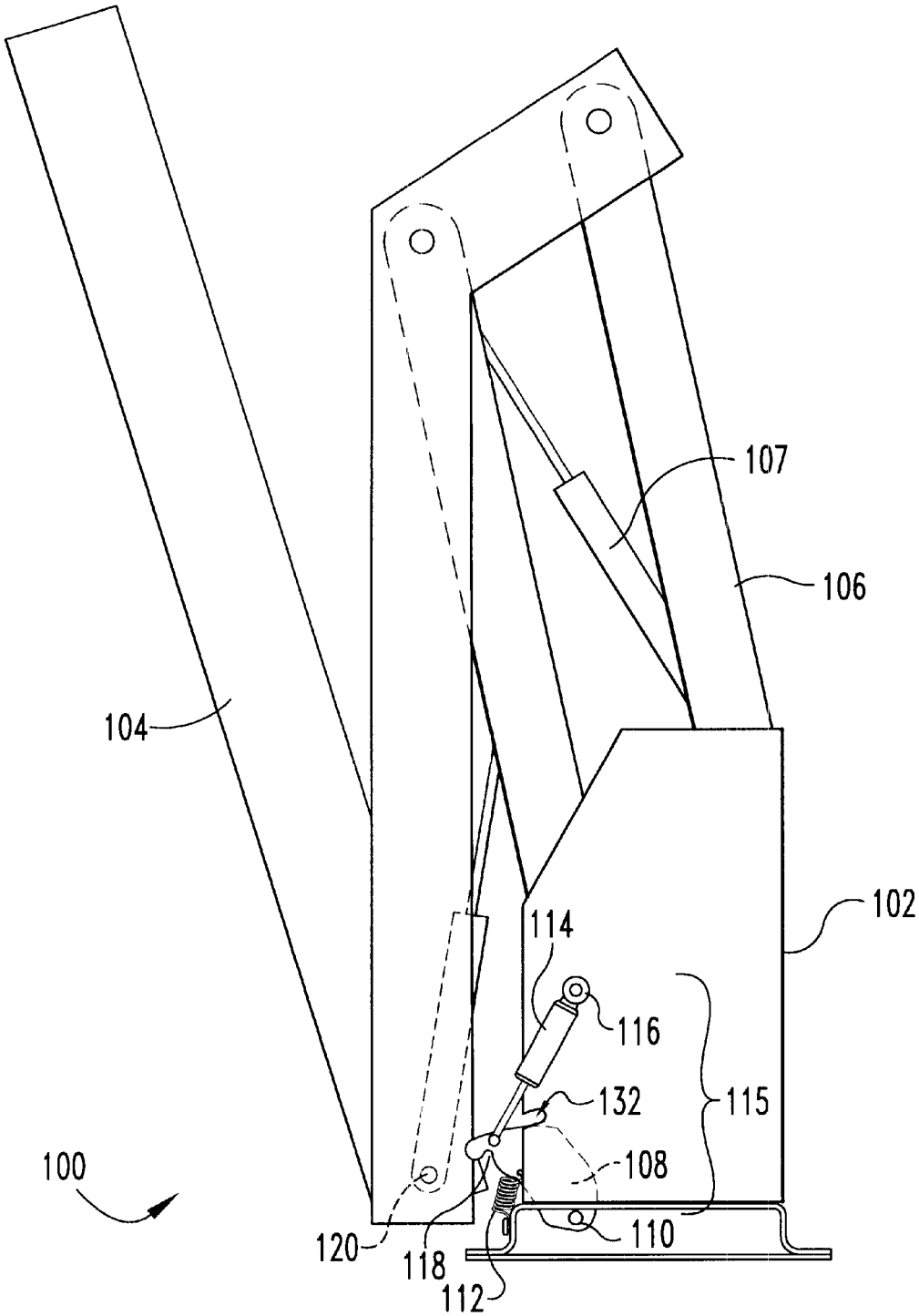
FIG. 6C is a schematic view of the platform assembly of the present invention in a partially deployed position.
Figure 6D:
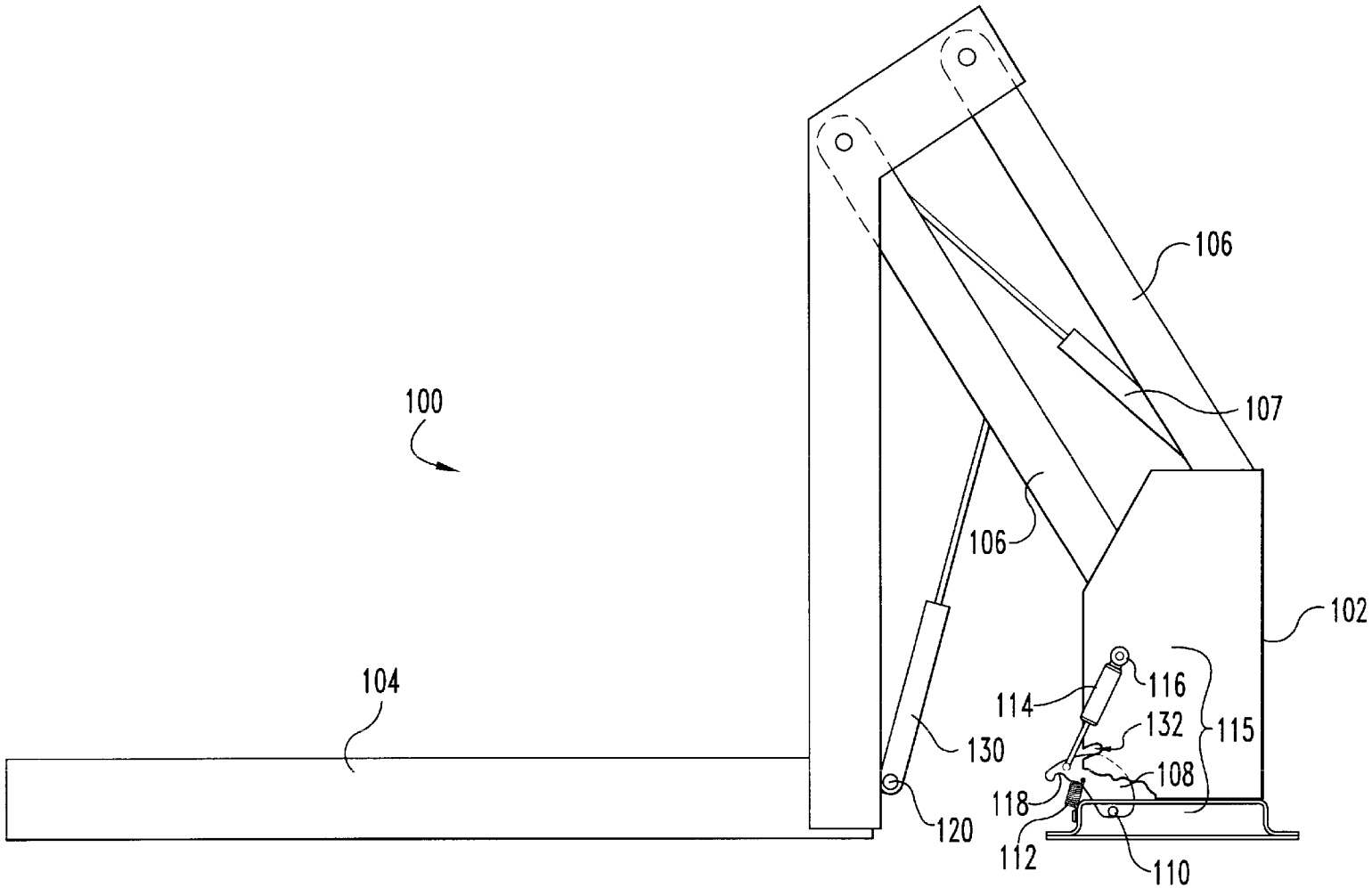
FIG. 6D is a schematic view of the platform assembly of the present invention in a deployed position.
Figure 7:
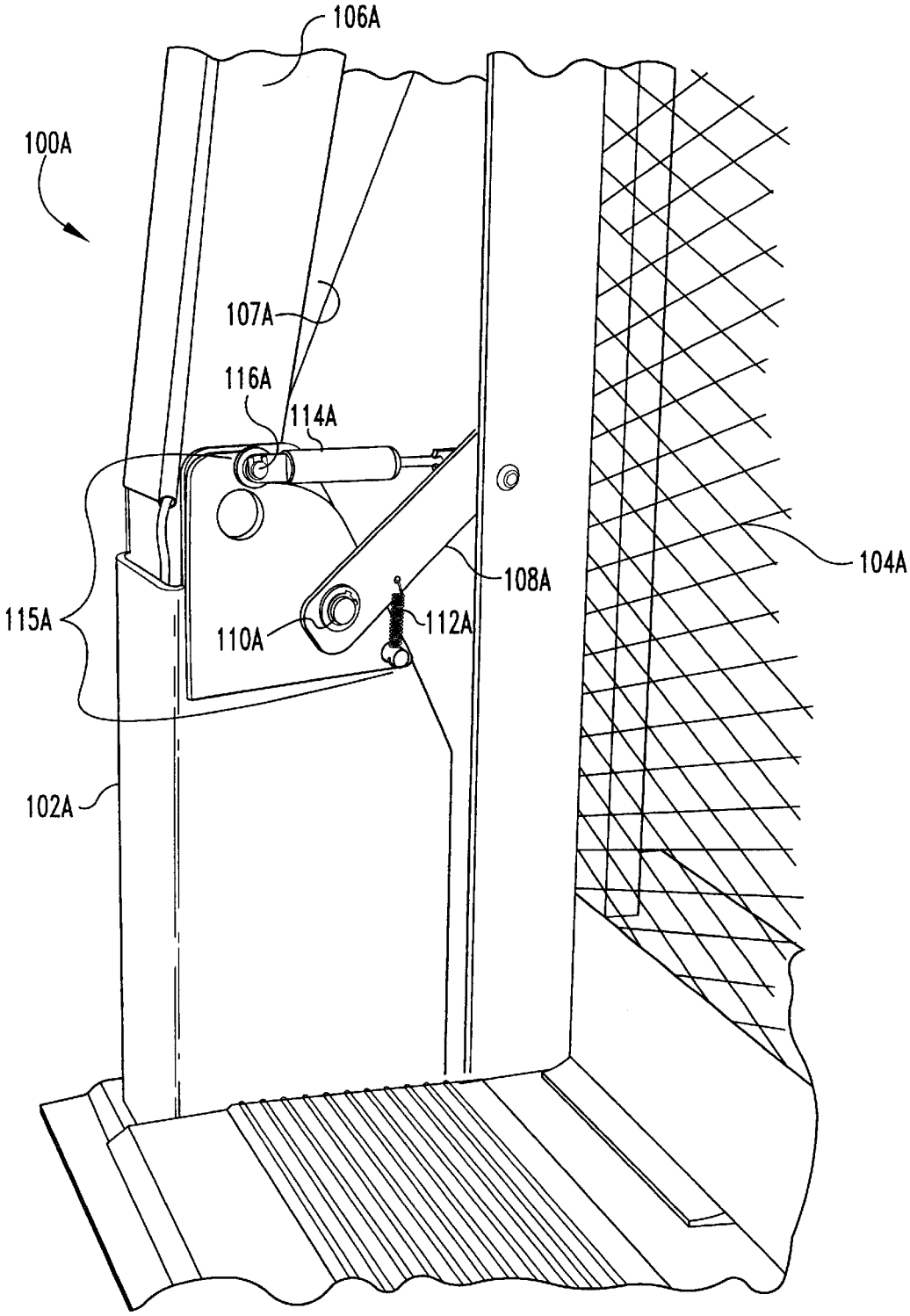
FIG. 7 is a partial perspective view of a second embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

FIGS. 2–6D illustrate a standard hydraulic parallel arm lift, indicated generally at 100, to which a first embodiment locking device 115 of the present invention has been incorporated. The lift 100, which is best viewed in its entirety in FIG. 6D, includes a lifting frame 102 attached to the entry doorway of the vehicle that is to be serviced by the lift 100. The lift 100 further includes a foldable platform 104, which is movable with respect to the frame 102 by some lifting means known in the art, such as a pair of parallel arms 106 driven by a hydraulically actuated cylinder 107. In accordance with the present invention, a lever arm 108 is pivotally connected to the lifting frame 102 at pivot point 110. Pivot point 110 located near the bottom of lifting frame 102 and is configured such that the lever arm 108 is relatively free to rotate therearound. The lever arm 108 is connected to pivot point 110 near its proximal end, the lever arm 108 having an opposite, distal end. A first biasing member 112, such as a mechanical spring, is coupled between the lever arm 108 and the lifting frame 102 in such a way as to bias the lever arm 108 toward the platform 104. The lever arm 108 is further coupled to the lifting frame 102 by means of a second biasing and/or motion-damping member 114, such as a gas spring. The lever arm 108, pivot point 110, and the first and second biasing members 112, 114 together define a locking assembly 115.

Gas spring 114 is coupled to the lifting frame 102 at a pivot point 116. The lever arm 108 includes a notch 118 formed therein near its distal end. A post 120 is secured to the platform 104 such that the post 120 will be engaged within the notch 118 when the platform 104 is moved into the stowed position. In this embodiment, the post is secured to a biasing member 130 adapted urge the platform 104 into the stowed position, although the post 120 may be secured to any portion of the platform 104 convenient to the placement of the locking assembly 115. The distal end of the lever arm 108 includes a curved camming surface 124 (see FIGS. 2–5) effective to guide the post 120 into the notch 118 when the platform 104 is stowed. A recess 132 is preferably formed into the lifting frame 102 to accommodate the locking assembly 115 during the platform 104 retraction, locking and/or unlocking operations.

The operation of the locking assembly 115 is illustrated schematically in FIGS. 6A–D. Prior to stowing the platform 104 (as can be best seen in FIG. 6D), the spring 112 acts to pivot the lever arm 108 around the pivot point 110 so that it is in the position shown corresponding to approximately full extension of the gas spring 114. As the platform 104 is folded into the stowed position, the post 120 comes into contact with the curved camming surface 124. Further retraction of the platform 104 into the stowed position causes the lever arm 108 to pivot around the pivot point 110 in a direction which compresses the gas spring 114 and extends the spring 112 by virtue of the camming surface 124 sliding upon the post 120 (i.e., the pivoting force acts in a direction opposite the direction urged by the biasing member 112). Once the post 120 has cleared the camming surface 124, it slips into the notch 118. This corresponds to the fully stowed position of the platform 104 illustrated in FIG. 6A. Because the lever arm 108 provides a secure connection between the lifting frame 102 and the platform 104, any drift of the hydraulic lifting cylinders 107 will not result in outward movement of the platform 104. The platform 104 is held securely in position by the physical interference of the lever arm 108/notch 118 with the post 120.

In order to unfold the platform 104 from the stowed position, the control system operating the hydraulic lifting cylinders 107 is programmed to momentarily further retract the hydraulic lifting cylinders 107 in the stowed direction. (see FIG. 6B) before reversing direction and unfolding the platform 104 away from the vehicle (see FIGS. 6C–6D). This momentary movement in the stowed direction causes the post 120 to push the lever arm 108 further backwards, compressing the gas spring 114 and extending the spring 112. In other words, moving the folded platform 104 further toward the stowed position before moving the platform 104 into the deployed position disengages the locking assembly 115 from post 120. The hydraulic cylinders 107 are operated in this direction just long enough to move the lever arm 108 back far enough such that the post 120 may now clear the notch 118 when the platform 104 is deployed (i.e., folded away from the vehicle entrance). It will be noted that as soon as the hydraulic lifting cylinders 107 move the platform 104 away from the stowed position, the spring 112 will act to pivot the lever arm 108 back into locking position; however, momentary resistance offered by the gas spring 114 prevents the lever arm 108 from being pivoted into the locking position until the post 120 has cleared the notch 118, thereby allowing the platform 104 to be unfolded from the stowed position. The force of the spring 112 does, however, eventually overcome the resistance of the gas spring 114, thereby positioning the lever arm 108/notch 118 into position for latching to the post 120 the next time the platform 104 is folded into the stowed position (i.e. the lever arm 108 is automatically reset).

Those having ordinary skill in the art will recognize that the lever arm 108 provides a simple and effective means for locking the platform 104 to the lifting frame 102 in order to prevent drift of the platform 108 when the lift is in the stowed position. Although only one side of the lift 100 is illustrated in FIGS. 2–6D, the preferred embodiment of the present invention includes a lever arm 108 positioned to couple the platform 104 on either side thereof, although the present invention contemplates the use of only a single lever arm 108. Furthermore, an alternative embodiment allows integration of the spring 112 and the gas spring 114, such that the gas spring 114 includes an internal spring, which tends to urge the gas spring 114 into its extended position.

As is known in the art, movement of the lift 100 is normally controlled by an automatic control system that moves the lift 100 in response to commands from a human operator. Such commands are normally given by activating one or more switches (not shown) coupled to the control system. From the above description, it will be recognized by those having skill in the art that the control system is desirably programmed to momentarily move the lift toward the stowed position when the operator commands deployment. This moves the lever arm 108 out of engagement with the post 120. The control system may then move the lift 100 toward the deployed position in the normal manner. The present invention also comprehends the use of a control system that requires the operator to command movement toward the stowed position followed by a command for movement toward the deployed position (i.e., not an automated sequence) in order to disengage the locking assembly 115.

Referring to FIGS. 7–10, there is shown a second hydraulic parallel arm lift, indicated generally at 100A, to which a second embodiment locking device 115A has been incorporated. The lift 100A includes a lifting frame 102A that is permanently or semi-permanently attached to the entry doorway of the vehicle that is to be serviced by the lift 100A. The lift 100A further includes a foldable platform 104A, which is moved with respect to the frame 102A by some lifting means 106A known in the art, such as a pair of parallel lifting arms. Preferably, the lifting arms 106A are actuated by one or more hydraulic cylinders 107A. The platform 104A is preferably hinged to accommodate folding, and is more preferably adapted to move between an extended, deployed orientation and a folded, stowed orientation. The lift 100A is illustrated in the stowed orientation in FIG. 7. In accordance with the present invention, a lever arm 108A is pivotally connected to the lifting frame 102A at pivot point 110A. Pivot point 110A is configured, such as by means of a bolt and nut, such that the lever arm 108A is relatively free to rotate therearound. The lever arm 108A is connected to pivot point 110A near its proximal end, the lever arm 108A having an opposite, distal end. A first biasing member 112A, such as a mechanical spring, is coupled between the lever arm 108A and the lifting frame 102A in such a way as to bias the lever arm 108A toward the platform 104A. The lever arm 108A is further coupled to the lifting frame 102A by means of a second biasing and/or motion-damping member 114A, such as a gas spring. The gas spring 114A is coupled to the lifting frame 102A at a pivot point 116A. The lever arm 108A, pivot points 110A, 116A and the first and second biasing members 112A, 114A together define a locking assembly 115A.

Figure 8:
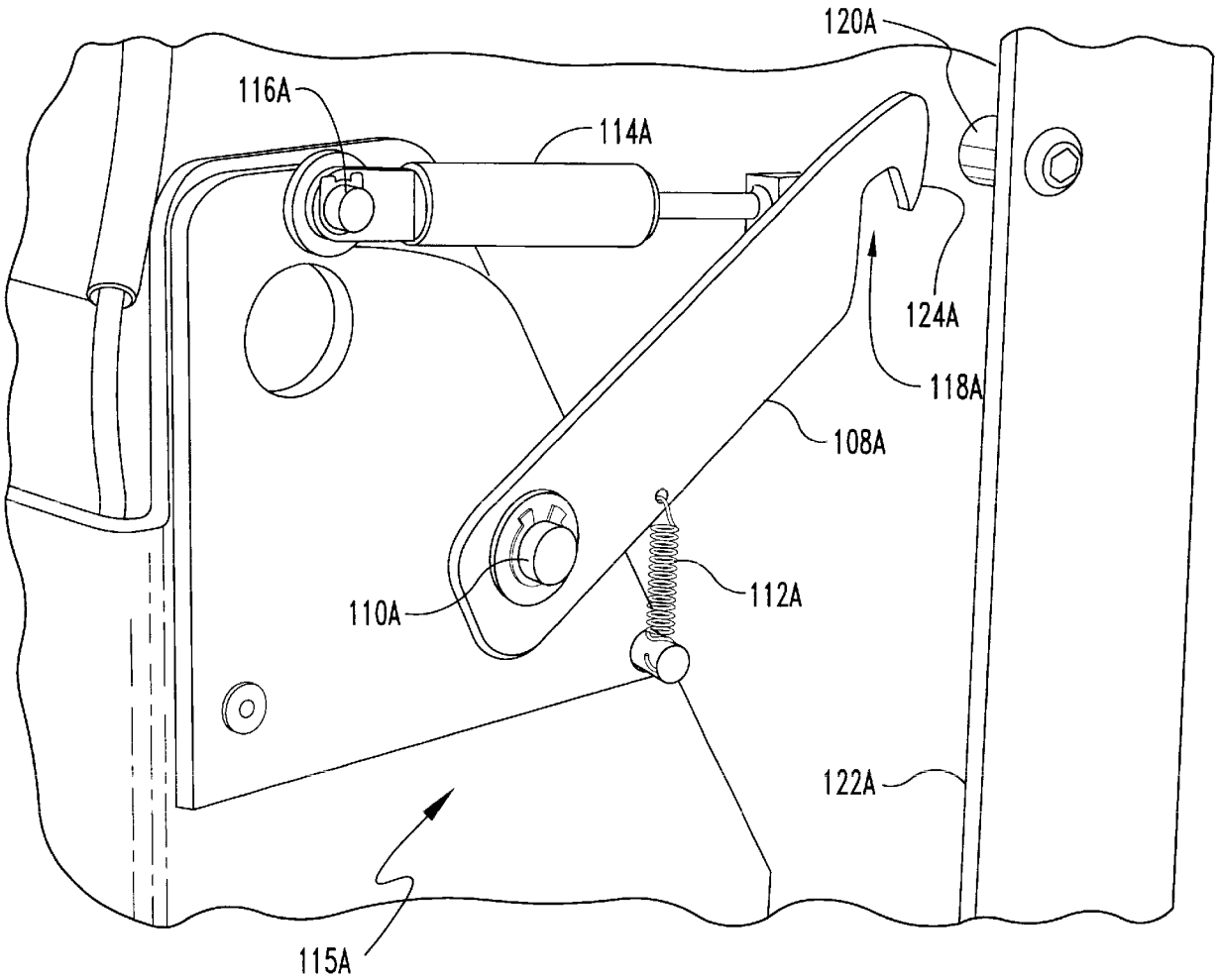
FIG. 8 is a first enlarged partial perspective view of FIG. 7 showing a disengaged locking assembly.
Figure 9:
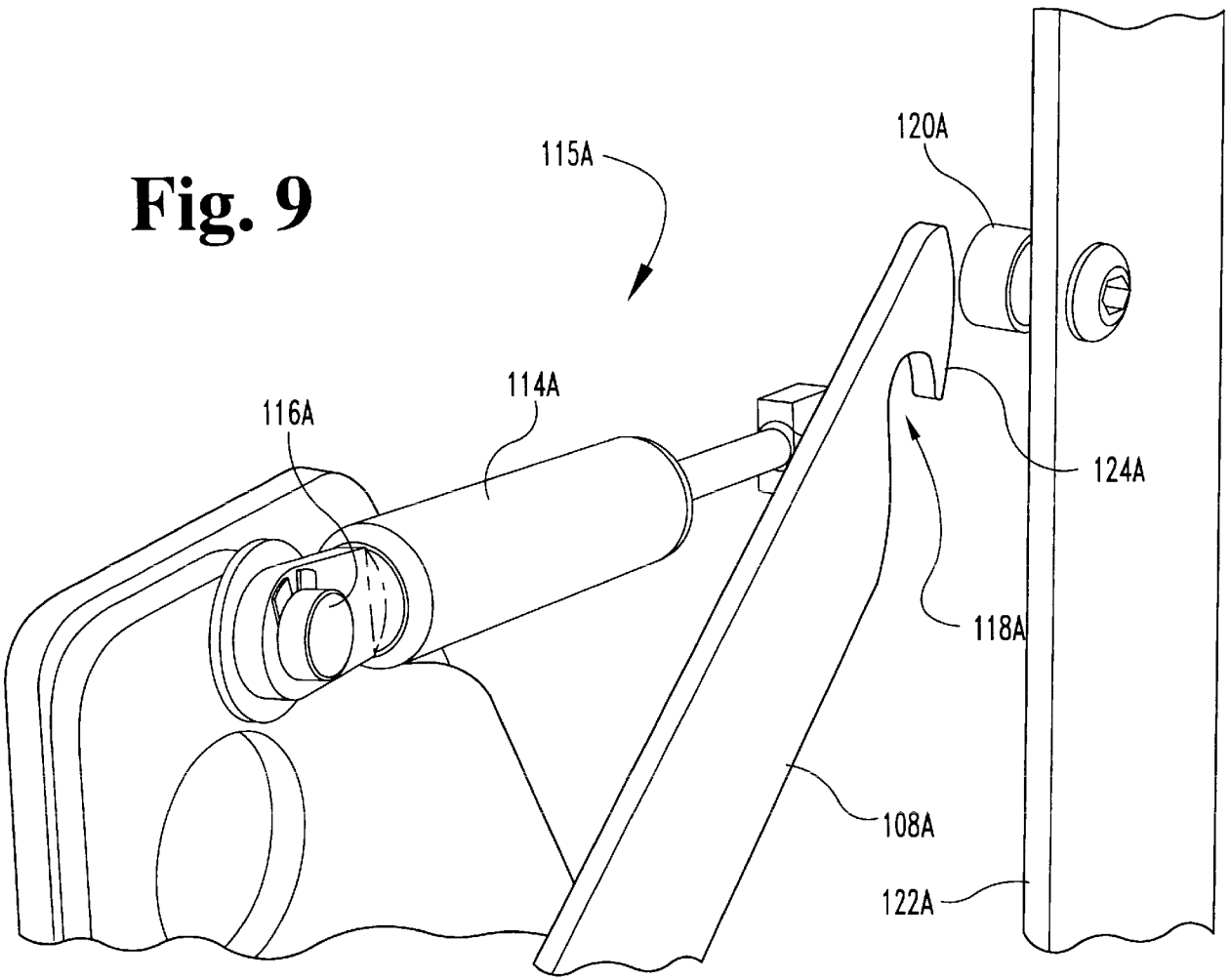
FIG. 9 is an enlarged partial perspective view of FIG. 8.
Figure 10:
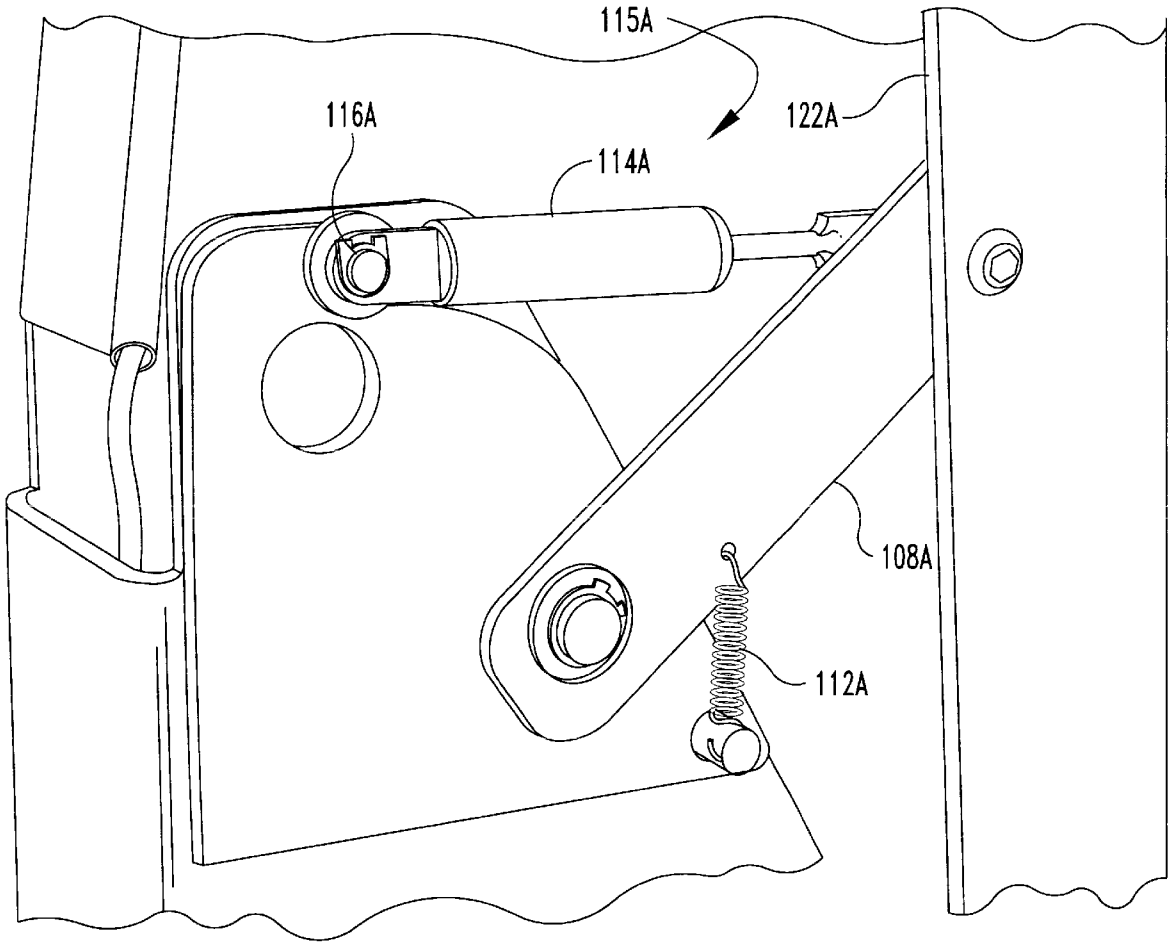
FIG. 10 is a second enlarged partial perspective view of FIG. 7 showing an engaged locking assembly.

The arrangement of the lever arm 108A is shown in greater detail in FIGS. 8–10. The lever arm 108A includes a notch 118A formed therein near its distal end. A post 120A is secured to a side rail 122A of the platform 104A such that the post 120A will be engaged within the notch 118A when the platform 104A is moved into the stowed position shown in FIG. 7. As can be seen in the views of FIGS. 8 and 9, the distal end of the lever arm 108A includes a curved camming surface 124A that is effective to guide the post 120A into the notch 118A when the platform 104A is stowed.

It will be appreciated that the second embodiment locking assembly 115A operates in substantially the same manner as the first embodiment locking assembly 115, the substantial difference being the locations of the pivots 110A/116A with respect to the lifting frame 102A and the location of the post 120A with respect to the platform 104A. It is thus illustrated that the relative location of the various components of the locking assembly of the present invention are not critical, all such arrangements falling within the scope of the present invention.

As described above, the post extends from the lifting arm/platform assembly and the locking assembly is coupled to the frame. It will be appreciated by one having ordinary skill in the art that the invention will also function with the post extending from the frame and the locking assembly connected to the lifting arm/platform assembly.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A wheelchair lift for use in conjunction with a vehicle having a floor, comprising:

a lifting frame mountable to the floor of the vehicle;

a hydraulic cylinder actuator operable with the lifting frame;

a lifting arm/platform assembly, comprising:

at least one lifting arm having a first end pivotally coupled to said lifting frame and a second end connected to said platform and adapted to pivot said platform between a substantially vertical stowed position and a substantially horizontal deployed position with the hydraulic cylinder actuator;

a post extending from said lifting arm/platform assembly; and a locking assembly coupled to the lifting frame and further comprising:

a lever arm pivotably coupled to said lifting frame, wherein positioning the platform to the substantially vertical stowed position causes disengagement of the post and the lever arm;

a gas spring extending between said lever arm and said lifting frame and operating to resist pivoting of said lever arm in a first direction; and a mechanical spring extending between said lever arm and said lifting frame and exerting a biasing force operating to pivot said lever arm in the first direction to engage said post in opposition to the gas spring;

wherein drift of the hydraulic cylinder actuator pivoting said platform from the vertical stowed position engages said post with said lever arm by allowing the mechanical spring to operate in opposition to the gas spring.

2. The wheelchair lift of claim 1 wherein said lifting arm/platform assembly may be moved in a stow direction toward the substantially vertical stowed position, wherein said lifting arm/platform assembly may be moved in a deploy direction toward the substantially horizontal deployed position, and wherein said lifting arm/platform assembly is adapted to move said platform from the substantially vertical stowed position into the substantially horizontal deployed position by sequentially moving in the stow direction to disengage said lever arm and then moving in the deploy direction until said platform is in the substantially horizontal deployed position.

3. The wheelchair lift of claim 2 wherein moving said lifting arm/platform assembly in the stow direction extends said mechanical spring, and wherein moving said lifting arm/platform assembly in the deploy direction moves said post in the deploy direction faster than said lever arm moves in the deploy direction.

4. The wheelchair lift of claim 1 wherein said platform is adapted to be manually pivoted.

5. The wheelchair lift of claim 1 wherein said platform further comprises automated lifting means for pivoting said platform.

6. The wheelchair lift of claim 1 wherein the post is connected to the platform.

7. The wheelchair lift of claim 1 wherein the post is connected to the at least one lifting arm.

8. A wheelchair lift system, comprising:

a vehicle having a floor;

a door formed in said vehicle;

a lifting frame mounted in said vehicle;

a hydraulic cylinder actuator operable with the lifting frame;

a platform assembly movably mounted in said lifting frame and adapted to move with the hydraulic cylinder actuator between an extended deployed orientation and a folded stowed orientation; and a locking assembly further comprising:

a post connected to said platform assembly;

a notched lever arm pivotably connected to said lifting frame;

a biasing member extending between said notched lever arm and said lifting frame; and a motion-damping member extending between said notched lever arm and said lifting frame in opposition to the biasing member; and wherein positioning the platform assembly in the stowed orientation causes disengagement of the post and the lever arm while drift of the hydraulic cylinder actuator allows the notched lever arm to be biased and to lockingly engage said post when said platform assembly is moved from the stowed orientation.

9. The wheelchair lift system of claim 8 wherein said biasing member is a mechanical spring and wherein said motion-damping member is a pneumatic cylinder.

10. The wheelchair lift system of claim 8 wherein said locking assembly is disengaged by moving said platform assembly further towards the stowed orientation before moving said platform assembly into the deployed orientation.

11. The wheelchair lift system of claim 8 wherein said notched lever arm further comprises a camming surface.

12. The wheelchair lift system of claim 8 wherein said platform assembly further comprises:

a platform;

a lifting arm operationally connecting said lifting frame and said platform; and lifting means operationally connected to said lifting arm;

wherein said lifting arm is adapted to move between a platform-deployed position and a platform-stowed position;

wherein movement of said lifting arm into the platform-deployed position actuates movement of said platform into the extended deployed orientation; and wherein movement of said lifting arm into the platform-stowed position actuates movement of said platform into the folded stowed orientation.

13. A wheelchair lift assembly for use in conjunction with a vehicle having a floor, comprising:

a lifting frame mountable to the floor of the vehicle;

a hydraulic cylinder actuator operable with the lifting frame;

a lifting arm/platform assembly, comprising:

a platform; and at least one lifting arm having a first end pivotally coupled to said lifting frame and a second end connected to said platform and adapted to pivot said platform between a substantially vertical stowed position and a substantially horizontal deployed position with the hydraulic cylinder actuator;

a post extending from said lifting arm/platform assembly; and a locking assembly coupled to the lifting frame and further comprising:

a lever arm pivotably coupled to said lifting frame, wherein positioning the platform to the substantially vertical stowed position causes disengagement of the post and the lever arm;

wherein drift of the hydraulic cylinder actuator pivoting said platform from the vertical stowed position engages said post with said lever arm by allowing the mechanical spring to operate in opposition to the gas spring.

14. The wheelchair lift assembly of claim 13 wherein the locking assembly further comprises a gas spring extending between said lever arm and said lifting frame and operating to resist pivoting of said lever arm in a first direction in opposition thereto.

15. The wheelchair lift assembly of claim 14 wherein the locking assembly further comprises a mechanical spring extending between said lifting arm and said lifting frame and exerting a biasing force operating to pivot said lever arm in a first direction to engage said post in opposition to the gas spring.

16. The wheelchair lift assembly of claim 13 wherein the locking assembly further comprises a gas spring extending between said lever arm and said lifting frame and operating to resist pivoting of said lever arm in a first direction and an opposing mechanical spring extending between said lifting arm and said lifting frame and exerting a biasing force operating to pivot said lever arm in the first direction to engage said post, wherein said locking assembly is disengaged by moving said platform assembly further towards the stowed orientation before moving said platform assembly into the deployed orientation.

17. A device for lifting a wheelchair, comprising:

a vehicle having a floor;

a door formed in said vehicle;

a lifting frame mounted in said vehicle;

a hydraulic cylinder actuator operable with the lifting frame;

a platform assembly movably mounted in said lifting frame and adapted to move with the hydraulic cylinder actuator between an extended deployed orientation and a folded stowed orientation; and a locking assembly further comprising:

a post connected to said platform assembly;

a notched lever arm pivotably connected to said lifting frame;

wherein positioning the platform assembly in the stowed orientation causes disengagement of the post and the lever arm while drift of the hydraulic cylinder actuator allows the notched lever arm to be biased to lockingly engage said post when said platform assembly is moved from the stowed orientation.

18. The device of claim 17 wherein the locking assembly further comprises a biasing member extending between said notched lever arm and said lifting frame.

19. The device of claim 18 wherein the locking assembly further comprises a motion-damping member extending between said notched lever arm and said lifting frame in opposition to the biasing member.

20. The device of claim 17 wherein the locking assembly further comprises a biasing member extending between said notched lever arm and said lifting frame and an opposing motion-damping member extending between said notched lever arm and said lifting frame, wherein said locking assembly is disengaged by moving said platform assembly further towards the stowed orientation before moving said platform assembly into the deployed orientation.

21. A wheelchair lift for use in conjunction with a vehicle having a floor, comprising:

a lifting frame mountable to the floor of the vehicle;

a hydraulic cylinder actuator operable with the lifting frame;

a platform for providing wheelchair access to the vehicle;

a lifting arm pivotably coupled between the platform and the lifting frame to pivot the platform between a substantially vertical stowed position and a substantially horizontal deployed position with the hydraulic cylinder actuator; and a platform securement assembly disengaged with the positioning of the platform to the substantially vertical stowed position and engageable with the platform upon drift of the hydraulic cylinder actuator to limit outward movement of the platform from the vertical stowed position.

22. The wheelchair lift of claim 21, wherein the platform securement assembly comprises a post and lever arm locking assembly between the lifting frame and the platform.

23. The wheelchair lift of claim 22, wherein the platform securement assembly comprises a biasing member extending between the lever arm and the lifting frame and an opposing motion-damping member extending between the lever arm and the lifting frame maintaining disengagement of the platform securement assembly during operation from the substantially vertical stowed position to the substantially horizontal deployed position with the hydraulic cylinder actuator.

24. The wheelchair lift of claim 23, wherein the biasing member comprises a mechanical spring and the motion-damping member comprises a pneumatic cylinder.

25. The wheelchair lift of claim 23, wherein the platform securement assembly being engaged with the platform upon drift of the hydraulic cylinder actuator is disengageable by moving the platform further towards the stowed orientation before moving the platform from the substantially vertical stowed position to the substantially horizontal deployed position with the hydraulic actuator.

* * * * *